US009732998B2

(12) United States Patent
Leman et al.

(10) Patent No.: US 9,732,998 B2
(45) Date of Patent: Aug. 15, 2017

(54) METHOD AND SYSTEM OF USING A REVERSING VALVE TO CONTROL AT LEAST TWO HVAC SYSTEMS

(71) Applicant: Carrier Corporation, Farmington, CT (US)

(72) Inventors: Derek Leman, Brownsburg, IN (US); Matthew Austin, Indianapolis, IN (US)

(73) Assignee: Carrier Corporation, Jupiter, FL (US)

( * ) Notice: Subject to any disclaimer, the term of this patent is extended or adjusted under 35 U.S.C. 154(b) by 361 days.

(21) Appl. No.: 14/623,153

(22) Filed: Feb. 16, 2015

(65) Prior Publication Data

US 2015/0260437 A1 Sep. 17, 2015

Related U.S. Application Data

(60) Provisional application No. 61/951,004, filed on Mar. 11, 2014.

(51) Int. Cl.

| | |
|---|---|
| ***F25B 1/00*** | (2006.01) |
| ***F25B 41/04*** | (2006.01) |
| ***F25B 13/00*** | (2006.01) |

(52) U.S. Cl.

CPC ..... *F25B 41/046* (2013.01); *F25B 13/00* (2013.01)

(58) Field of Classification Search

CPC ..... F25B 41/06; F25B 13/00; F25B 49/02; F16K 31/122

See application file for complete search history.

(56) References Cited

U.S. PATENT DOCUMENTS

| | | | |
|---|---|---|---|
| 5,465,588 | A | 11/1995 | McCahill et al. |
| 5,507,315 | A | 4/1996 | Parker |
| 5,515,689 | A | 5/1996 | Atterbury |
| 6,378,323 | B1 | 4/2002 | Chavagnat |
| 7,152,416 | B2 | 12/2006 | Lifson et al. |
| 7,716,943 | B2 | 5/2010 | Seefeldt |
| 7,895,850 | B2 | 3/2011 | Kitsch |
| 8,056,348 | B2 | 11/2011 | Murakami et al. |
| 8,074,459 | B2 | 12/2011 | Murakami et al. |
| 8,220,531 | B2 | 7/2012 | Murakami et al. |
| 2011/0197610 | A1 | 8/2011 | Debesa |
| 2011/0214437 | A1 | 9/2011 | Jeong et al. |
| 2011/0259027 | A1 | 10/2011 | Choi et al. |
| 2012/0047930 | A1 | 3/2012 | Uselton |
| 2012/0255320 | A1 | 10/2012 | Kawagoe et al. |
| 2013/0019624 | A1 | 1/2013 | Tamaki et al. |
| 2013/0160985 | A1 | 6/2013 | Chen et al. |
| 2013/0269380 | A1 | 10/2013 | Oya |
| 2013/0291571 | A1* | 11/2013 | Amick ..... F25D 21/06 62/81 |

* cited by examiner

*Primary Examiner* — Elizabeth Martin
(74) *Attorney, Agent, or Firm* — Ice Miller LLP

(57) ABSTRACT

An HVAC system, including a reversing valve including a first port, a second port, and a third port, wherein the reversing valve may be placed into a first position in which the first port is operably coupled to the second port for the flow of refrigerant therebetween, and a second position in which the second port is operably coupled to the third port for the flow of refrigerant therebetween, a first HVAC component operably coupled to the first port, a second HVAC component operably coupled to the second port, and a third HVAC component operably coupled to the third port.

18 Claims, 4 Drawing Sheets

METHOD AND SYSTEM OF USING A REVERSING VALVE TO CONTROL AT LEAST TWO HVAC SYSTEMS

CROSS REFERENCE TO RELATED APPLICATIONS

The present application is related to, and claims the priority benefit of, U.S. Provisional Patent Application Ser. No. 61/951,004 filed Mar. 11, 2014, the contents of which are hereby incorporated in their entirety into the present disclosure.

TECHNICAL FIELD OF THE DISCLOSED EMBODIMENTS

The presently disclosed method generally relates to heating, ventilation, and air-conditioning (HVAC) systems, and more particularly, to a method and system of using a reversing valve to control at least two HVAC systems.

BACKGROUND OF THE DISCLOSED EMBODIMENTS

In a conventional HVAC system, a heat pump comprises a compressor which compresses a refrigerant and delivers the compressed refrigerant to a downstream condenser coil. From the condenser coil, the refrigerant passes through an expansion device, and subsequently, to an evaporator coil. The evaporator coil or condenser coil may be either an indoor fan coil or outdoor coil and may be the same coil that changes functions based on the direction of flow of the refrigerant. The indoor fan coil is coupled to a blower to deliver climate controlled air. The outdoor coil is located outside of the climate controlled area. When operating in cooling mode, the condensing coil is the outdoor coil and dissipates heat to the environment by condensing the refrigerant. The refrigerant then passes through an expansion device and subsequently to the indoor fan coil. The indoor coil is the evaporator coil and evaporates the refrigerant to reduce the indoor fan coil's temperature. The climate controlled air is moved through the indoor coil and is reduced in temperature by exchanging heat with the indoor fan coil. When operating in heating mode, the flow of refrigerant is reversed. The indoor fan coil becomes the condensing coil and dissipates heat to the climate controlled air raising its temperature. The refrigerant then passes through an expansion device and subsequently to the outdoor coil. The outdoor coil is now acting as the evaporator coil and evaporates the refrigerant to reduce the outdoor coil's temperature and absorb heat from the environment. This system is commonly known in the art as a split system. A reversing valve can be used to change the direction of flow of refrigerant within the system to change the operation of the indoor fan coil or outdoor coil to either an evaporator or condenser coil. In some systems it may be advantageous to have three or more coils because additional coils may serve to allow the HVAC system to perform multiple functions such as deliver refrigerant to a hot water system, and/or additional climate controlled air to a different area. Generally, solenoids are used to direct the flow of refrigerant to the appropriate system in operation. These solenoids operate as a switch changing the path of the refrigerant from an inlet port between two or more outlet ports. The solenoids contain a mechanism to switch the path of the refrigerant between one or more ports, thereby directing the refrigerant to different parts of the HVAC system. This disclosure is directed to a more cost effective method of directing refrigerant compared to prior art solenoid systems.

SUMMARY OF THE DISCLOSED EMBODIMENTS

In one aspect, a reversing valve for controlling an HVAC system is disclosed comprising a reversing valve including a first port, a second port, and a third port, wherein the reversing valve may be placed into a first position in which the first port is operably coupled to the second port for the flow of refrigerant therebetween, and a second position in which the second port is operably coupled to the third port for the flow of refrigerant therebetween. The HVAC system includes a first HVAC component operably coupled to the first port, a second HVAC component operably coupled to the second port, and a third HVAC component operably coupled to the third port.

In at least one embodiment, the reversing valve further includes a fourth port; and a static volume operably coupled to the fourth port. In at least one embodiment, the HVAC system further comprises a first check valve operably coupled between the first HVAC component and the first port. In at least one embodiment, the HVAC system further includes a second check valve operably coupled between the third HVAC component and the third port. In at least one embodiment, the HVAC system further comprises the aspect wherein the first position operably couples the third HVAC component to the fourth port. In at least one embodiment, the HVAC system further comprises the aspect wherein the second position operably couples the first HVAC component to the fourth port. In at least one embodiment, the first HVAC component includes an appliance for conditioning air. In at least one embodiment, the first HVAC component includes an appliance for heating water. In at least one embodiment, the second HVAC component is a heat pump. In at least one embodiment, the third HVAC includes an appliance for conditioning air. In at least one embodiment, the third HVAC component includes an appliance for heating water.

In one aspect, a method of controlling an HVAC system is disclosed. In one embodiment, the method includes the step of commanding a reversing valve to move to a first position. The method further includes the step of operating a first HVAC component and a second HVAC component to circulate a refrigerant therebetween. The method further includes the step of commanding the reversing valve to move from the first position to a second position. The method further includes the step of operating the second HVAC component and a third HVAC component to circulate a refrigerant therebetween.

In at least one embodiment, the first HVAC component includes an appliance for conditioning air. In at least one embodiment, the first HVAC component includes an appliance for heating water. In at least one embodiment, the second HVAC component is a heat pump. In at least one embodiment, the third HVAC component includes an appliance for conditioning air. In at least one embodiment, the third HVAC component includes an appliance for heating water. In at least one embodiment, the first position operably couples the third HVAC component to a static volume within the reversing valve. In at least one embodiment, the second position operably couples the first HVAC component to a static volume within the reversing valve.

In at least one embodiment, the method further comprises the steps of equalizing a pressure of the static volume with a pressure of the second HVAC component when the reversing valve is in the first position and the pressure of the second HVAC component is lower than the pressure of the static volume, and equalizing the pressure of the static volume with a pressure of the first HVAC component when the reversing valve is in the second position and the pressure of the first HVAC component is lower than the pressure of the static volume.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
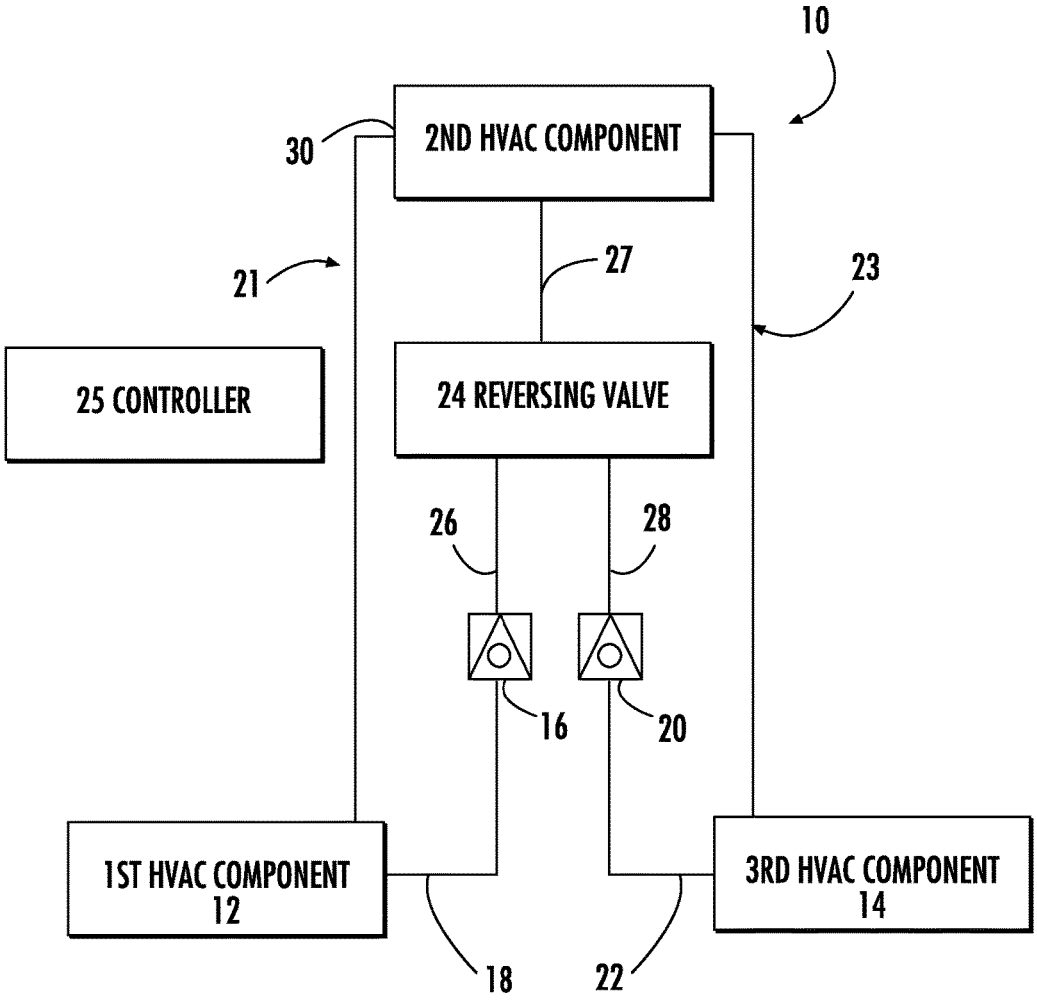
FIG. 1 is an schematic component drawing of an HVAC system operative to use a reversing valve to control at least two HVAC components according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 schematically illustrates an embodiment of an HVAC system, generally indicated at 10. A first HVAC component 12 is operably coupled to a first component check valve 16 via a conduit 18. The first HVAC component 12 is configured to circulate a refrigerant therethrough. In at least one embodiment, the first HVAC component 12 includes an appliance for conditioning air. In at least one embodiment, the first HVAC component 12 includes an appliance for heating water. For example, the first HVAC component 12 may include a fan coil, furnace/evaporator coil combination, and a water heater module to name a few non-limiting examples. The first component check valve 16 is configured to restrict the flow of refrigerant therethrough in one direction. The first component check valve 16 is operably coupled to a reversing valve 24 via a conduit 26. The reversing valve 24 is configured to alternate between a first position and a second position. In at least one embodiment, a controller 25 is in electrical communication with the reversing valve 24, the first HVAC component 12, a second HVAC component 30, and a third HVAC component 14. The reversing valve 24 is operably coupled to the second HVAC component 30 via a conduit 27. The second HVAC component 30 is configured to circulate a refrigerant therethrough. In at least one embodiment, the second HVAC component 30 is a heat pump.

A third HVAC component 14 is operably coupled to a second component check valve 20 via a conduit 22. The third HVAC component 14 is configured to circulate a refrigerant therethrough. In at least one embodiment, the third HVAC component 14 includes an appliance for conditioning air. In at least one embodiment, the third HVAC component 14 includes an appliance for heating water. For example, the third HVAC component 14 may include a fan coil, furnace/evaporator coil combination, and a water heater module to name a few non-limiting examples. The second component check valve 20 is configured to restrict the flow of refrigerant therethrough in one direction. The second component check valve 20 is operably coupled to the reversing valve 24 via a conduit 28.

Figure 2:
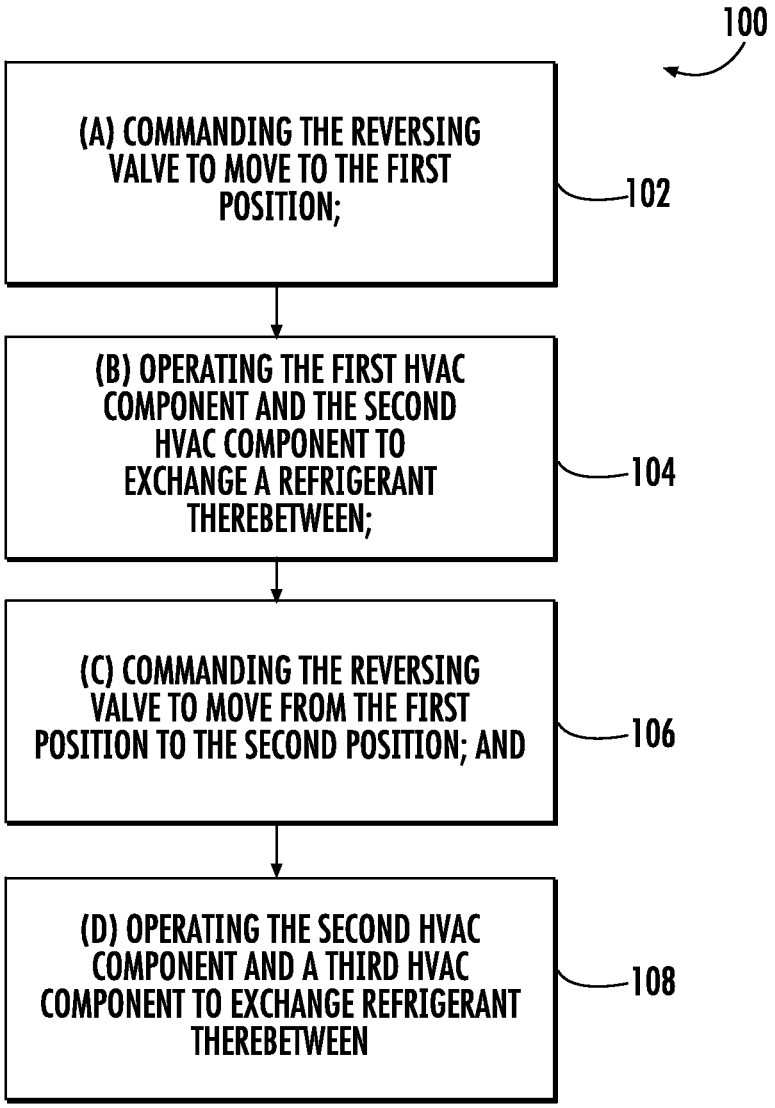
FIG. 2 is a schematic flow diagram of a method of operating an HVAC system using a reversing valve to control at least two HVAC components according to at least one embodiment of the present disclosure.

FIG. 2 schematically illustrates a method of using a reversing valve to operate at least two HVAC systems, the method generally indicated at 100. The method 100 comprises step 102 of commanding the reversing valve 24 to switch to a first position. In at least one embodiment, the reversing valve 24 is commanded to switch to a first position or to a second position by receiving a signal from the controller 25. For example, if the first HVAC system has a demand for conditioning an interior space or a demand to heat water, a signal from the first HVAC component 12 is sent to the controller 25. If the controller 25 determines that the first HVAC component 12 may operate, based upon predetermined rules executed by the controller, the controller 25 sends a signal to the reversing valve 24 to switch to the first position to allow the flow of refrigerant to circulate through the first HVAC component 12 and the second HVAC component 30.

The method 100 further comprises the step 104 of operating the first HVAC component 12 and the second HVAC component 30 to circulate a refrigerant therebetween. Generally, when there is a demand to condition an interior space or a demand to heat water, the second HVAC component 30 operates in a heating or a cooling mode to circulate a refrigerant therethrough. The refrigerant exits the second HVAC component 30 and enters the reversing valve 24 through conduit 27. Depending on which system is creating the demand, the reversing valve 24 is put into either the first position or the second position, thereby respectively directing refrigerant to either the first HVAC component 12 or the third HVAC component 14 for conditioning the interior space or heating water. The refrigerant is returned to the second HVAC component 30 via either conduit 21 or conduit 23 depending on whether the first HVAC component 12 or the third HVAC component 14 is operating. The refrigerant will continue to flow through the aforementioned circuit until the demand to condition an interior space or demand to heat water is satisfied.

The method 100 further comprises the step 106 of commanding the reversing valve to move from the first position to the second position. The reversing valve 24 is commanded to switch from a first position to a second position or from a second position to a first position by receiving a signal from the controller 25. For example, if the third HVAC component 14 has a demand for conditioning an interior space or a demand to heat water while the first HVAC component 12 is operating, a signal from the third HVAC component 14 is sent to the controller 25. If the controller 25 determines that the third HVAC component 14 may operate, based upon predetermined rules executed by the controller 25, the controller 25 sends a signal to the reversing valve 24 to switch from the first position to the second position to allow the flow of refrigerant to circulate through the third HVAC component 14 and second HVAC component 30. After the reversing valve 24 switches from the first position to the second position, the first HVAC component 12 stops circulating refrigerant; however, high pressure-high temperature refrigerant remains within the first HVAC component 12. The first component check valve 16 prevents the high pressure refrigerant still within the first HVAC component 12 from being transmitted to the reversing valve 24, while simultaneously allowing a lower pressure within the reversing valve 24 to equalize with the first HVAC component 12 once the first HVAC component 12 achieves a lower pressure than the low pressure stored within the reversing valve (as explained in greater detail hereinbelow with respect to FIGS. 3 and 4). A static volume within the reversing valve 24 may contain the lower pressure. A pressure differential may be utilized to switch or maintain the reversing valve 24 from the first position to the second position or from the second position to the first position. The low pressure contained within the static volume may be equalized with the inactive HVAC component to prevent pressure build up and to allow consistent operation of the reversing valve 24.

Once the controller 25 sends a signal to the reversing valve 24 to switch positions to allow the flow of refrigerant to circulate through the third HVAC component 14, the method moves to step 108 of operating the second HVAC component 14 and the third HVAC component 30 to circulate refrigerant therebetween. The second HVAC component 30 and the third HVAC component 14 are operated in accordance with the principals described above in step 104.

Figure 3:
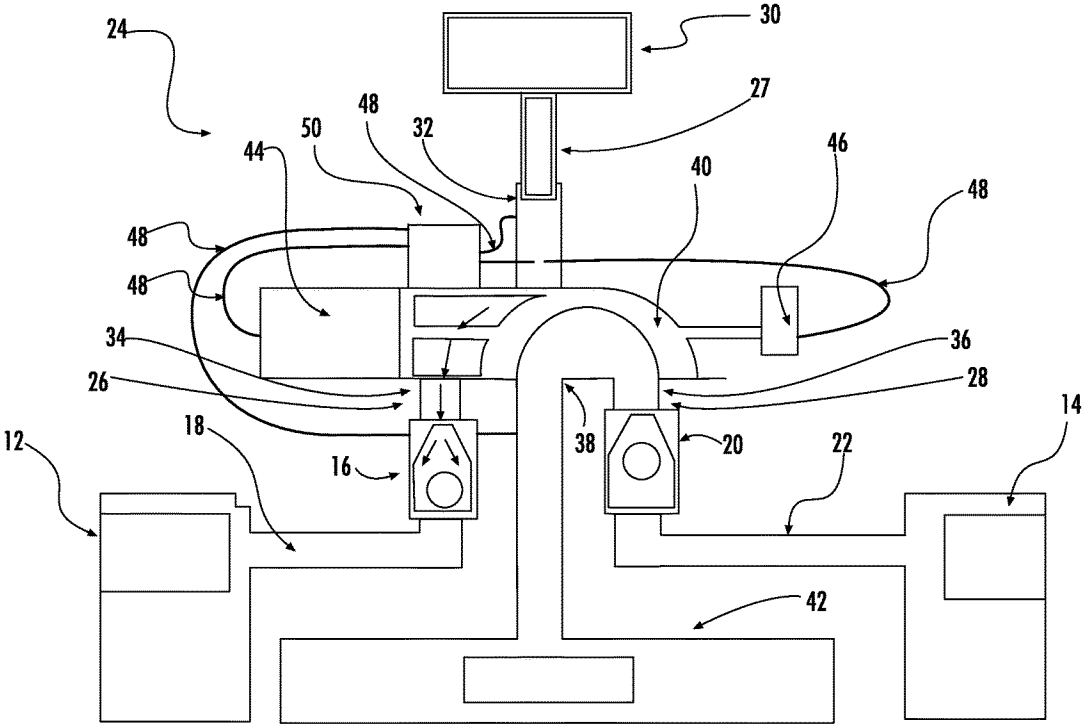
FIG. 3 is a schematic diagram of one embodiment of a reversing valve shown in a first position operable to perform a method of operating an HVAC system using a reversing valve to control at least two HVAC components according to at least one embodiment of the present disclosure.
Figure 4:
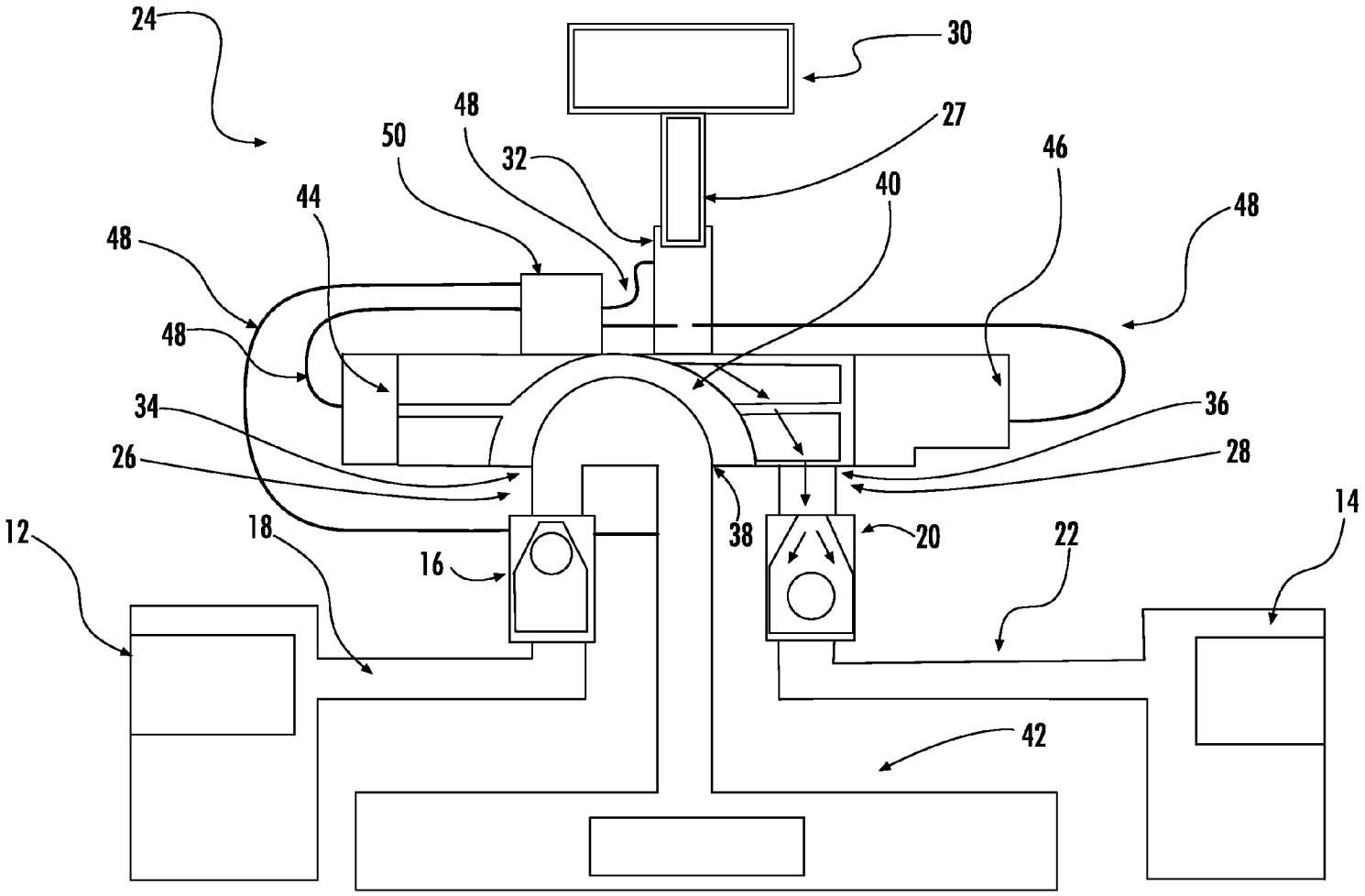
FIG. 4 is a schematic diagram of one embodiment of a reversing valve shown in a second position operable to perform a method of operating an HVAC system using a reversing valve to control at least two HVAC components according to at least one embodiment of the present disclosure.

FIG. 3 depicts a schematic view of a reversing valve 24 that may perform the method according to at least one embodiment. The reversing valve 24 includes a first port 32. The first port 32 is configured to accept incoming refrigerant from the second HVAC component 30 via conduit 27. The reversing valve 24 further includes a second port 34 operably coupled to the conduit 26, a third port 36 operable coupled to the conduit 28 and a fourth port 38 operably coupled to a static volume 42. The second port 34 is configured to direct refrigerant from the first port 32 to the first HVAC component 12 via conduit 26 when the reversing valve 24 is in the first position. The third port 36 is configured to direct refrigerant from the first port 32 to the third HVAC component 14 via conduit 28 when the reversing valve 24 is in the second position. The reversing valve 24 contains a shuttle 40 configured to move between a first shuttle position and a second shuttle position. When the shuttle 40 is in the first position (as shown in FIG. 3), refrigerant is directed from the second HVAC component 30, through the first port 32, to the second port 34, and to the first HVAC component 12. While the shuttle 40 is in the first position, the second HVAC component 12 is operably coupled to the static volume 42 through the third port 36 and the fourth port 38. When the shuttle 40 is in the second position (as shown in FIG. 4), refrigerant is directed from the second HVAC component 30 to the first port 32, to the third port 36, to the third HVAC component 14. The first HVAC component 12 is operably coupled to the static volume 42 through the second port 34 and the fourth port 38 when the shuttle 40 is in the second position.

The reversing valve 24 contains a first activation section 44 and a second activation section 46 operably coupled to move the shuttle 40 between the first and second shuttle positions. Pressure from the operation of the first, second and/or third HVAC components 12, 14 and/or 30 is directed to the first activation section 44 or the second activation section 46 to move the shuttle 40 from the first shuttle position to the second shuttle position (or vice versa) through a plurality of pressure connections 48. A solenoid 50 includes a first solenoid position and a second solenoid position operable to transfer pressure to the first activation section 44 and/or the second activation section 46 via the plurality of pressure connections 48. In at least one embodiment, the solenoid 50 is commanded by a signal to switch from the first solenoid position to the second solenoid position causing the shuttle 40 to switch from the first shuttle position to the second position. In at least one embodiment, the signal to the solenoid can be sent from a separate controller (such as the controller 25 or another controller), a controller within the solenoid 50 itself, or the first, second or third HVAC component 12, 14 or 30. The first solenoid position operably connects the first port 32 to the first activation section 44 and operably connects the static volume 42 to the second activation section 46. The second solenoid position operably connects the first port 32 to the second activation section 46 and operably connects the static volume 42 to the first activation section 44.

As an example of one embodiment of performing the method 100, the shuttle 40 begins in the first position as shown in FIG. 3. The solenoid 50 begins in the first solenoid position operably connecting the first activation section 44 to the first port 32 and the second activation section 46 to the static volume 42. The circulation of refrigerant travels from the second HVAC component 30 to the first port 32 and through the second port 34, the conduit 26, the check valve 16, the conduit 18, and to the first HVAC component 12, operating the first HVAC system. The circulation of refrigerant from the second HVAC component 30 through first port 32 causes a first pressure to increase due to the buildup of heat in the refrigerant and moving of the refrigerant through the first HVAC component 12 and connected conduits 18 and 26, first port 32, port 34, and check valve 16. The increased first pressure at first port 32 is in communication with the first activation section 44 via pressure connections 48 causing the first activation section 44 to expand, maintaining the shuttle 40 in the first shuttle position. The static volume 48 has a static volume pressure. The second activation section 46 is in communication with the static volume 42 via pressure connections 48, causing a second pressure within the second activation section 46 to equalize with the static volume pressure and maintain a lower pressure than the first pressure of the first activation section 44.

Referring now to FIG. 4, when the solenoid 50 is commanded to switch from the first solenoid position to the second solenoid position, the first port 32 is operably connected to the second activation section 46 via pressure connections 48, and the static volume 42 is operably connected to the first activation section 44 via pressure connections 48. The first pressure contained within the first activation section 44 is equalized with the static volume 42, resulting in a slight increase in the static volume pressure, yet this equalized pressure is still lower than the previous first pressure. The second pressure contained within the second activation section 46 is equalized with the pressure at first port 32 via pressure connections 48. The second pressure of the second activation section 46 is now at a higher pressure than the first pressure of the first activation section 44, which operably moves the shuttle 40 to the second shuttle position, thereby operably coupling the first port 32 to the third port 36 and also operably coupling the second port 34 to the fourth port 38. The operable coupling of the first port 32 to the third port 36 operably couples the second HVAC component 30 to the third HVAC component 14, thereby allowing the circulation of refrigerant therethrough and operation of the second HVAC system. The operable coupling of the second port 34 to the fourth port 38 operably couples the first HVAC component 12 to the static volume 42 through conduits 18 and 26, and check valve 16. As the first HVAC component 12 was previously active and at a high pressure from the circulation of refrigerant from the second HVAC component 30, the check valve 16 engages because the first HVAC component's 12 pressure is higher than the static volume pressure, thereby preventing pressure from suddenly increasing in the static volume 42. As the first HVAC component 12 cools or no longer circulates refrigerant, the first HVAC component's 12 pressure reduces, and once the pressure has reduced to a pressure lower than the static volume pressure the check value 16 releases, allowing the previous slight increases in static volume pressure caused by the equalization with the first pressure of the first activation system 44 during circulation of refrigerant to the first HVAC component 12 to be reduced to a lower static volume pressure. This allows a constant change of the reversing valve by providing a sufficient pressure differential between the first and second pressures and connected first and second activation sections 44 and 46.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An HVAC system, comprising:

a reversing valve comprising a first port, a second port, a third port and a fourth port, wherein the reversing valve may be placed into a first position in which the first port is operably coupled to the second port for the flow of refrigerant therebetween, and a second position in which the second port is operably coupled to the third port for the flow of refrigerant therebetween;

a first HVAC component operably coupled to the first port;

a second HVAC component operably coupled to the second port;

a third HVAC component operably coupled to the third port; and a static volume operably coupled to the fourth port.

2. The HVAC system of claim 1 further comprising:

a first check valve operably coupled between the first HVAC component and the first port;

wherein the first check valve prevents the flow of refrigerant from the first HVAC component into the first port.

3. The HVAC system of claim 2, further comprising:

a second check valve operably coupled between the third HVAC component and the third port;

wherein the third check valve prevents the flow of refrigerant from the third HVAC component into the third port.

4. The HVAC system of claim 1, further comprising a controller in electrical communication with the reversing valve, the first HVAC component, the second HVAC component, and the third HVAC component.

5. The HVAC system of claim 1 wherein, the first position operably couples the third HVAC component to the fourth port.

6. The HVAC system of claim 1 wherein, the second position operably couples the first HVAC component to the fourth port.

7. The HVAC system of claim 1 wherein, the first HVAC component is an appliance for conditioning air.

8. The HVAC system of claim 1 wherein, the first HVAC component is an appliance for heating water.

9. The HVAC system of claim 1 wherein, the second HVAC component is a heat pump.

10. The HVAC system of claim 1 wherein, the third HVAC component is an appliance for conditioning air.

11. The HVAC system of claim 1 wherein, the third HVAC component is an appliance for heating water.

12. A method of controlling an HVAC system with a reversing valve including a first port, a second port, a third port, and a fourth, the method, comprising the steps of:

(a) commanding the reversing valve to move to a first position;

(b) operating a first HVAC component and a second HVAC component to circulate a refrigerant therebetween;

(c) commanding the reversing valve to move from the first position to a second position;

(d) operating the second HVAC component and a third HVAC component to circulate a refrigerant therebetween and (e) operably coupling a fourth port to a static volume.

13. The method of claim 12, wherein the first HVAC component is operably coupled to the second port.

14. The method of claim 12 wherein, the second HVAC component is operably coupled to the first port.

15. The method of claim 12 wherein, the third HVAC component is operably coupled to the third port.

16. The method of claim 12 wherein, the first position operably couples the first port to the second port and the third port to the fourth port.

17. The method of claim 12, wherein the second position operably couples the first port to the third port and the second port to the fourth port.

18. The method of claim 12 further comprising:

(f) equalizing a pressure of the static volume with a pressure of the third HVAC component when the reversing valve is in the first position and the pressure of the third HVAC component is lower than the pressure of the static volume; and (g) equalizing the pressure of the static volume with a pressure of the first HVAC component when the reversing valve is in the second position and the pressure of the first HVAC component is lower than the pressure of the static volume.

* * * * *